United States Patent [19]

Burton

[11] 4,044,877

[45] Aug. 30, 1977

[54] MULTIPLE COLUMN VENDING MACHINE MALFUNCTION LOCKOUT CIRCUIT

[75] Inventor: Paul F. Burton, Charles Town, W. Va.

[73] Assignee: Dixie-Narco, Inc., Ransom, W. Va.

[21] Appl. No.: 655,846

[22] Filed: Feb. 6, 1976

[51] Int. Cl.[2] ..... G07F 5/22

[52] U.S. Cl. ..... 194/10; 221/129; 221/125; 221/21

[58] Field of Search ..... 194/9, 10, 2; 221/125, 221/129, 21

[56] References Cited

U.S. PATENT DOCUMENTS

| | | | |
|---|---|---|---|
| 3,486,601 | 12/1969 | Bowman | 194/10 |
| 3,669,235 | 6/1972 | Breeden | 194/10 |
| 3,848,718 | 11/1974 | Bookout | 194/10 X |
| 3,998,357 | 12/1976 | Levasseur | 221/129 X |

*Primary Examiner*—Robert B. Reeves
*Assistant Examiner*—Joseph J. Rolla
*Attorney, Agent, or Firm*—Bacon & Thomas

[57] ABSTRACT

An electrically operated control circuit for a multiple selection vending machine with lockout circuits to isolate mal-functioning sections, thereby enabling continued vending machine operations via the remaining functional sections. The lockout circuitry is particularly directed toward sensing and compensating for jammed conditions in the product dispensing mechanisms using a minimal amount of additional circuit elements over non-protected counterpart machines. The malfunction lockout circuitry includes a motor-cam driven embodiment, and a unique thermally sensitive motor thermostat actuated embodiment.

10 Claims, 2 Drawing Figures

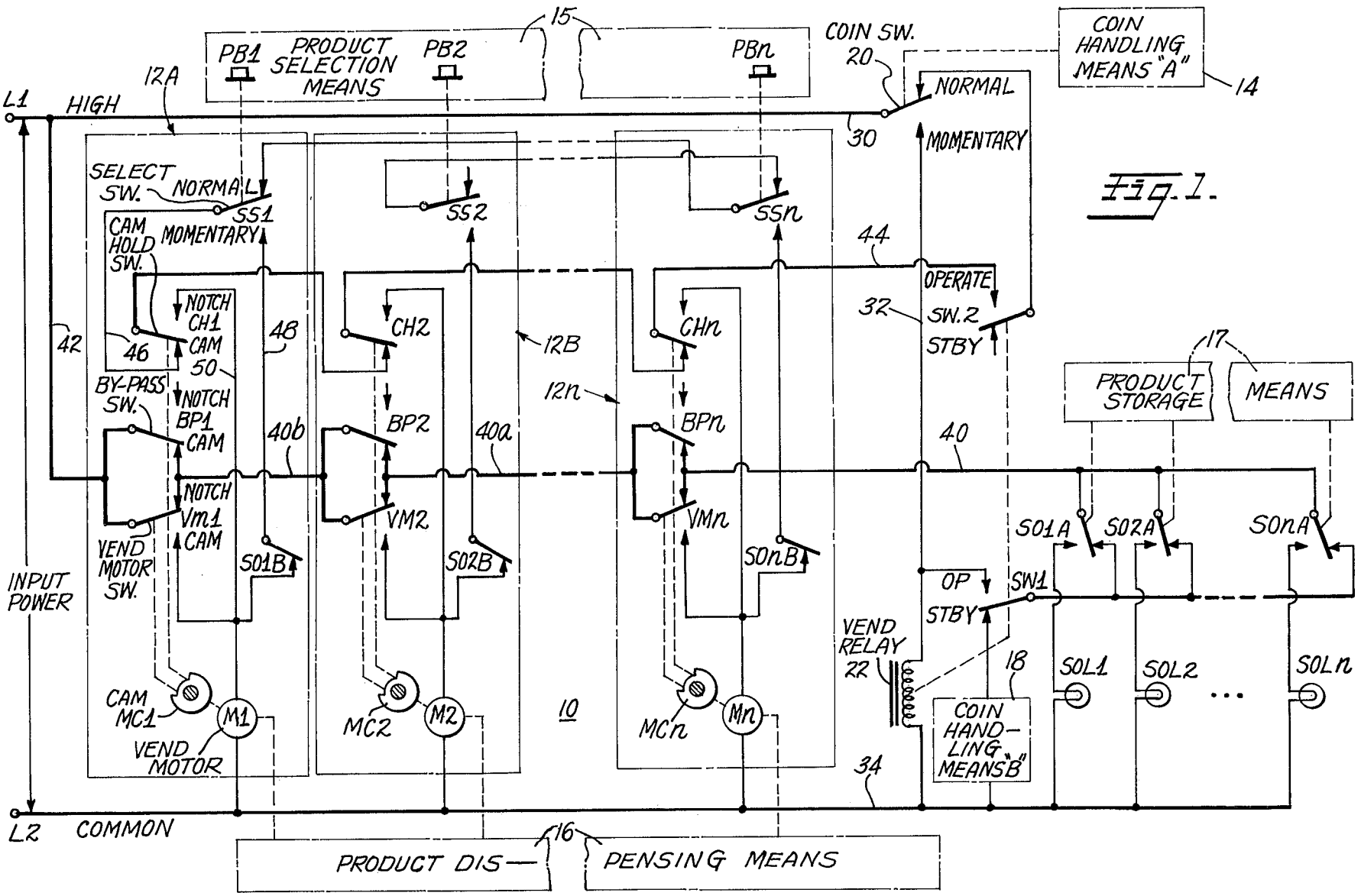
COIN HANDLING MEANS "A"
14
FIG. 1.
PRODUCT STORAGE
MEANS
17
SOnA
SOL n
SO2A
SOL 2
SO1A
SOL 1
SW1
18
COIN HAND-LING MEANS "B"
NORMAL
MOMENTARY
OPERATE
SW.2
STBY
40
OP
STBY
COIN SW.
20
30
44
32
VEND RELAY
22
34
PBn
SSn
SOnB
CHn
BPn
VMn
Mn
MCn
PENSING MEANS
15
12B
12n
10
16
PRODUCT DIS-
PB2
SS2
SO2B
CH2
BP2
VM2
M2
MC2
PRODUCT SELECTION MEANS
PB1
48
40b
SO1B
SS1
NORMAL
MOMENTARY
NOTCH CH1 CAM
50
NOTCH BP1 CAM
NOTCH VM1 CAM
M1
VEND MOTOR
12A
SELECT SW.
CAM HOLD SW.
46
BY-PASS SW.
VEND MOTOR SW.
CAM MC1
HIGH
42
INPUT POWER
COMMON
L1
L2

MULTIPLE COLUMN VENDING MACHINE MALFUNCTION LOCKOUT CIRCUIT

BACKGROUND OF THE INVENTION

1. Field of the Invention

The present invention relates to lockout circuits for use in electrically operated and controlled multiple column vending machines, wherein the vending machines are actuated by the deposit of coins, and the selecting and dispensing of the product is accomplished by logically operated control elements within the machine. More specifically, the invention relates to several embodiments of lockout circuitry which function to permit continued operation of the multiple column vending machine in the event of a malfunction of a particular column.

2. Description of the Prior Art

Electrically operated multiple column vending machines including lockout features are well known. Over the years the vending machine industry has developed a number of machine circuit configurations directed towards providing economical and reliable lockout means to assure the fullest possible utilization of their vending machine capabilities. Thus, while the problem of having a multiple column machine rendered completely inoperative due to failure of a single column has received considerable effort, the lockout mechanisms proposed and employed invariably include a significant amount of additional electrical and mechanical devices over non-protected counterpart machines. The additional components in themselves contribute to lowering the overall reliability of the machines due to the increased complexity introduced. Various conventional solutions to the jammed column lockout condition show the inclusion of additional electrically operated/-mechanically interlocked relays for each product column, while other earlier attempts included mechanical interlocking means. Exemplary prior art approaches may be found in the Breeden U.S. Pat. No. 3,669,235 and the Bowman U.S. Pat. No. 3,486,601. Therefore, while the prior art shows consideration effort directed toward providing the malfunction lockout capability, it is clear that a completely satisfactory approach has yet to be developed.

SUMMARY OF THE INVENTION

Therefore, the primary object of the invention is to provide an effective lockout circuit for a multiple column vending machine while reducing to a practical minimum both the attendant additional circuit complexity and additional costly components.

A further object of the present invention is to provide a lockout feature in a multiple column vending machine utilizing to a large measure those components already extant in conventional vending machines not having a lockout feature.

A further object of the present invention is to provide the desired malfunction lockout capability only for those portions of the product dispensing cycle wherein a jam or other malfunction is most probable. This provides the very desirable feature of inhibiting unwanted operating modes by specifically time tailoring the lockout capabilities to the machine sequence in progress at a given time.

A further object of the present invention is to provide first and second portions of a vending machine dispensing cycle, wherein the first portion is characterized by having the particular column actuating circuit in a first condition corresponding to the establishment of credit; and the second portion characterized by having the particular column actuating circuit in a second condition corresponding to the cancellation of credit, and further by enabling the desired malfunction bypass circuitry without the addition of a separate relay for each actuating circuit.

BRIEF DESCRIPTION OF THE DRAWINGS

Additional objects and advantages of the invention will become apparent to those skilled in the art as the description proceeds with reference to the accompanying drawings wherein:

FIG. 1 is a schematic diagram of a preferred embodiment of the vending machine control circuit including the malfunction lockout circuitry of the instant invention.

DETAILED DESCRIPTION OF THE PREFERRED EMBODIMENTS

Figure 2:
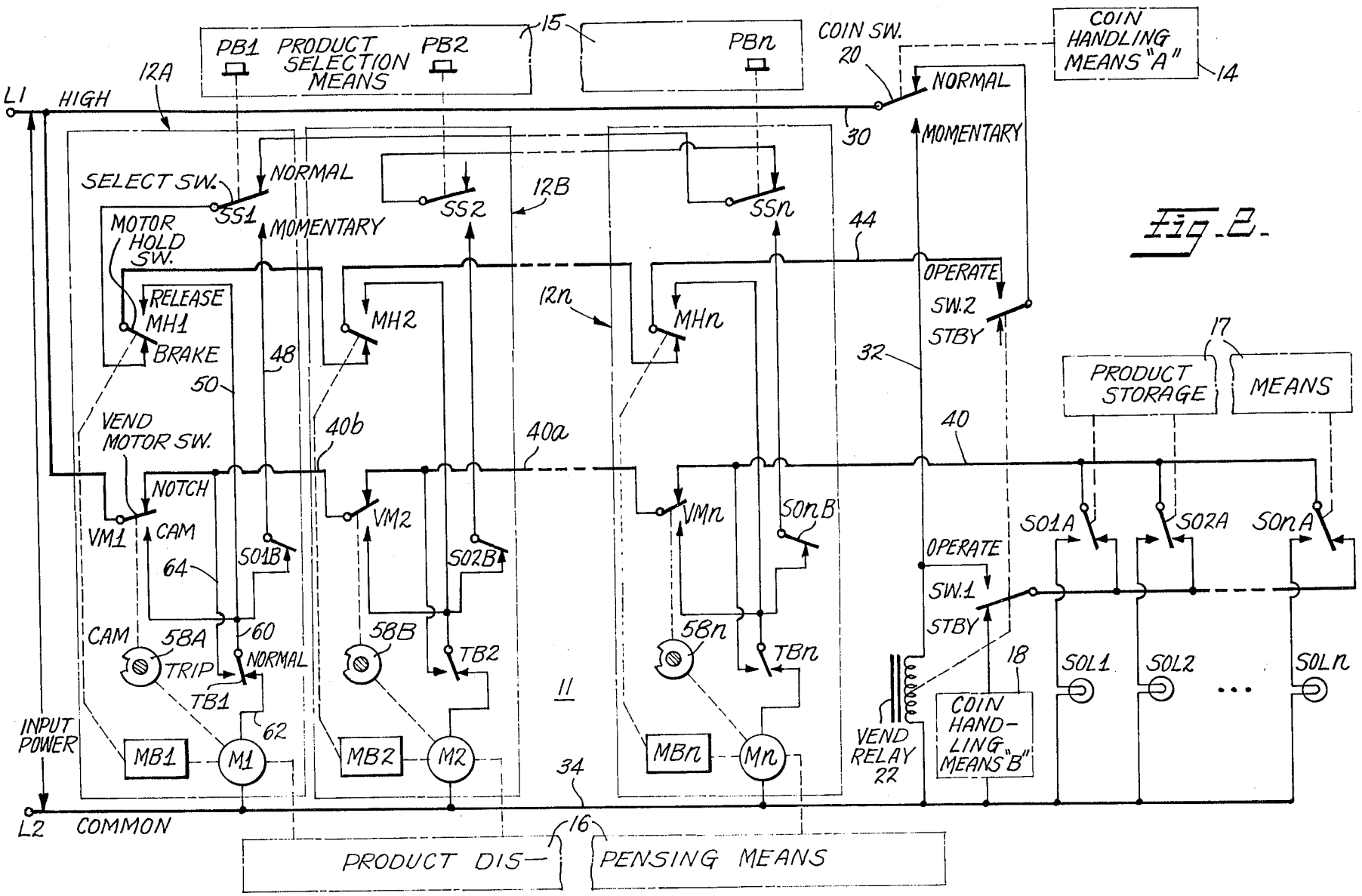
FIG. 2 is a schematic diagram of an alternate embodiment of the lockout circuitry including a manually reset thermostat bypass switch.

Referring initially to FIGS. 1 and 2, there are shown two different vending machine control circuits 10 and 11 corresponding to the two illustrative embodiments of the instant invention. Each is individually described in more detail hereinbelow. In both cases the control circuits are shown in a normal standby condition. This condition is characterized as being a quiescent or standby condition wherein the vending machine mechanisms have not experienced any malfunctions in previous vending cycles, and are ready and able to receive coins and dispense products. Additionally, the control circuits shown represent a condition wherein none of the product columns have been sold out.

It will be noted that the vending machine control circuits illustrated in FIGS. 1 and 2 are of the multiple-selection, independent column type. For simplicity, only three independent columns have been illustrated, however it will become clear from the detailed description of operation of a single column, that only simple iteration is required for the description to encompass any number of independent columns. The vending machine control circuits 10 and 11 comprise individual column actuating circuits 12A, 12B, and **12*n*;** and additionally, other portions of the control circuit which are common to all of the individual column control circuits.

For clarity, certain other portions of the multiple column vending machine are shown in simplified block form, as they do not comprise part of the instant invention. These blocks are: a Coin Handling means A 14; a Product Selection means 15; a Product Dispensing means 16; a Product Storage means 17; and a Coin Handling means B 18. Product Storage means 17 is shown as directly actuating only a plurality of Sold Out Switches SO1A-SOnA; however, the Product Storage means 17 also actuates a plurality of Sold Out switches SO1B-SOnB, wherein the mechanical interconnections are not shown for clarity of illustration. The two coin handling means, Coin Handling means A 14 and Coin Handling means B 18, may be integrated into a single mechanism. They are shown here as separate blocks corresponding nominally to their two functions. Coin Handling means A 14 is that portion of the integral mechanism which, after the proper amount of coins have been totalized, initiates a vend cycle. Coin Handling means B 18 is the conventional coin return electromagnet, CREM, mechanism which, when energized allows coins to be accepted for totalizing; and when deenergized causes any coins deposited to be immediately returned. Hereinafter, for simplicity, only that portion of the integral mechanism associated with initiation of a vend cycle will be discussed.

CYCLE OF OPERATION — PREFERRED EMBODIMENT

Referring to FIG. 1, the vending machine control circuit 10 including a preferred embodiment of the lockout circuitry is shown.

A cycle of operation is initiated upon the receipt of the proper coins into Coin Handling means A 14. The Coin Handling means A 14 then actuates a single-pole-double-throw momentary Coin Switch 20, thereby placing the actuating circuits **12A–12*n* into stable intermediate conditions, ready for product selection and dispensing. On actuation of the Coin Switch 20, its movable pole momentarily transitions to its "Momentary" position applying the high side of an input power source (not shown) via a terminal L1 and lines 30 and 32 directly to one side of a credit establishing means, hereinafter referred to as a Vend Relay 22. The other side of Vend Relay 22 is connected to the input power source Common via a line 34 and a terminal L2. Vend Relay 22 is thus energized and its two sets of contacts SW1 and SW2, as they transition to their "Operate" position, then perform the following two functions. Contacts SW1 continue to hold the Vend Relay 22 energized after the momentary actuation provided by the Coin Switch 20. The movable pole of SW1 transitions to its Operate position thereby connecting the Vend Relay 22 to the High side L1 of the input power via the following path: through one or more of the plurality of Sold-Out Switches SOlA-SOnA, (this implies that not all of the product storage means have actuated the sold-out switches) thereafter via a line 40,** through the series connection of all of the normally closed contacts ("Notch" position) of a plurality of motor actuated switching means hereinafter referred to as Vend Motor switches VM*l*-VM*n,* via lines **40*a* and 40*b* and thereafter via a line 42 to the High side L1 of the input power. The Vend Relay 22, via its SW1** contacts, maintains itself in the energized position through one or more of the Sold Out switches SO*l*A-SO*n*A, and the series string of the Vend Motor switches VM*l–VMn.* Thus a first condition of the Vend Relay 22 is established which corresponds to the establishment of credit.

The SW2 contacts of Vend Relay 22 are used to route power to a plurality of Select Switches SS*l–SSn* as follows. The High side L1 of the input power is routed via line 30 through the Coin Switch 20, which has now returned to its "Normal"position after its momentary actuation by the Coin Handling means A. Connection is then made through SW2, whose movable pole has transitioned to its Operate position, a line 44, and thereafter through a plurality of series connected motor actuated switching means hereinafter referred to as Cam Hold switches CH*l*–CH*n,* ("Cam" position) and via a line 46 to the movable pole of the first of a plurality of single-pole-double-throw, momentary, Select Switches SS*l*–SS*n.* Each of the Select Switches SS*l*–SS*n* is customer operable and may initiate a dispense cycle for the particular product column selected. It should be noted that the Select Switches SS*l*–SS*n* are connected series cascade, in an interlocked arrangement such that one and only one selection may be made. Associated with Select Switch SSl, an exemplary switch-actuating Pushbutton PBl is shown. On actuation of the Pushbutton PBl, the movable pole of Select Switch SSl transitions to its Momentary position thereby applying actuating voltage to Vend Motor Ml via a line 48, and through the normally closed contacts of the single-pole-single-throw Sold Out switch SOlB. Vend Motor Ml begins rotation to actuate the product dispensing mechanism, and in addition drives an associated Cam MCl which operates a plurality of switches. These switches are the Vend Motor switch VMl, the Cam Hold switch CHl, and a Bypass switch BPl. This last switch is one of a plurality of motor actuated lockout swtiching means, BPl-BPn, hereinafter referred to as Bypass switches.

For ease of description, the three cam-driven switches are indicated as being in the Cam position (actuating levers resting on the high portion of the cam wheel), or the Notch position (actuating levers resting in the notch of the cam wheel). The momentarily actuated Select Switch serves to initiate the Vend Motor rotation only. Thereafter, the Cam Hold switch, which moves to the Notch position almost immediately after start of motor rotation, takes over and continues to energize the Vend Motor. This energizing path leads from Vend Motor M1 along a line 50, through the now-actuated Cam Hold switch CHl, (Notch position) and thereafter via all of the remaining series interlocking Cam Hold Switches CH2-CHn, (Cam-position), line 44, switch SW2 (Operate-position) and Coin Switch 20 (Normal-position) to the input power as before. At a predetermined point in the product dispensing cycle, the Vend Motor switch VMl is actuated by the motor driven Cam MCl thereby performing two functions. As the movable contact of Vent Motor switch VMl transitions to its Cam-position, it applies voltage directly from Ll via the line 42 to the Vend Motor Ml and therefore maintains the Vend Motor Ml energized for the remainder of the product dispensing cycle. Additionally, actuation of Vend Motor switch VMl deenergizes the Vend Relay 22 thereby cancelling the credit that the original coin deposit had established. Essentially, when the Vend Motor switch VMl moves to the Cam-position, it interrupts the holding circuit that had been established via the line 40, through all of the Vend Motor Switches VM*l*–VM*n* (Notch-position) in series, and the line 42. The movement of Vend Motor switch VMl to its Cam position also coincides with the actuation of the dispensing mechanism which physically contacts and moves the product within the column. At this point, machine malfunctions are most prevalent, particularly as the product may become jammed within the column, and thus the lockout circuitry of the instant invention comes into play. The lockout means is provided by the Bypass Switch BPl. Thus, shortly following Vend Motor actuation by switch, VMl, the Cam Hold switch CHl and the Bypass switch BPl are actuated to their Cam positions. Bypass switch BPl now completes the circuit from Ll, via the line 42 and the remainder of the Vend Motor switches in series such that a subsequent product selection could be made upon actuation of the Vend Relay 22 after the proper deposit of coins as described above. Thus, in the event of a malfunction which prevents the return of the Vend Motor switch VMl to its Notch position (as, for example, the jamming of a product within the selected column), subsequent product selections in different columns may be made inasmuch as the holding circuit for Vend Relay 22 is now made through the Bypass switch BPl (Cam position). Note that prior to actuation of the Bypass switch BPl, that particular enabling path was accomplished through the Vend Motor switch VMl. Thus it is clear that in the event that the Vend Motor Ml can not complete its product dispensing cycle, due to a jammed condition of the dispensing mechanism, and therefore that the Vend Motor switch VMl can not return to the Notch position, subsequent actuations of the machine can be accomplished via the Bypass switch path as above-described. If no mechanism jam ocurs, then a normal dispense cycle would be completed upon the Vend Motor switch VMl transitioning to its Notch position, thereby breaking the Vend Motor run circuit that had been established through the Cam position of the Vend Motor switch VMl.

There are therefore two distinct quiescent conditions possible at the completion of a particular vend cycle. Normally, in the event to machine jamming or other mechanism failure has occurred, all of the Vend Motor switches VMl-VMn will be in their respective Notch positions and therefore will provide the holding path for future operations of the Vend Relay 22. Note that a parallel path occurs across each of the Vend Motor switches by virtue of the Bypass switches being in the Cam position. This is merely a redundant path for the normal standby condition. The second quiescent condition occurs in the event of a jam of the product dispensing mechanism. In this case the particular Vend Motor effected will have been unable to complete its full rotational cycle and its cam-driven Vend Motor switch contact cannot arrive in the Notch position. Here, the associated Bypass switch will provide the complete path required for holding the Vend Relay 22 for subsequent machine vending actuations.

Several additional features associated with the control circuitry are also provided. A single-pole-single-throw Sold Out switch, one of the group SOlB-SOnB, is connected in series with each Vend Motor and the Motor's initial energizing path comprising its associated Select Switch. The Sold Out switches SO*l*B -SO*n*B are actuated in concert with their correspondingly numbered Sold Out switches SOlA-SO*n*A such that in the event the Product Storage means 17 detects a depleted column, both switches for a particular column are actuated. The switches of the group SO*l*A-SO*n*A energize their respective Sold Out lamps SOL*l*-SO*n*indicating to the customer that that product is not available. However, the switches of the group SO*l*B-SO*n*B will preclude selections of their particular column by inhibiting the initial actuation of the Vend Motor associated with that column.

The series cascading of the Select Switches is done in such a manner that multiple product selections are not possible. The normally closed fixed contact (Normal position) of Select Switch SSl is connected to the movable pole of Select Switch SSn; thereafter, the normally closed fixed contact (also Normal) of Select Switch SSn is connected to the movable pole of Select Switch SS2, and so on as shown in FIG. 1. Note, for example, what would happen if one attempted to actuate Select Switches SSl an SSn simultaneously. The selection would by default be made of the product in column number 1, due to the fact that immediately upon the movable pole of Select witch SSl transitioning away from its fixed contact, and prior to the time that it will reach its opposite fixed contact, the power is removed from the movable pole of the Select Switch SSn, thereby rendering actuation of Select Switch SSn ineffective. The hierarchy established by the wiring as shown sets up the following priority sequence — Select Switch SSl, then SSn, then SS2. In the event of multiple simultaneously actuations of any of these switches, the highest priority switch as indicated by the previous sequence would be the product column selected.

An additional safeguard against multiple product selection by rapid sequential (as compared to simultaneous) operation of more than one Select Switch is also provided. On actuation of any Select Switch, its associated Vend Motor immediately rotates, near simultaneously actuating the associated Cam Hold switch to the Notch position, as described above in connection with Vend Motor operation. This action instantly deenergizes all of the Select Switches, as they are powered through the series string of Cam Hold switches, thereby also preventing multiple product selection.

CYCLE OF OPERATION — THERMOSTAT EMBODIMENT

Referring now to FIG. 2, an alternate embodiment of the vending machine control circuit is shown. In this embodiment, by-pass action, in the event of a jam during product dispensing, is accomplished by means of a single-pole-double-throw, manually reset thermostat switch as will be described in detail hereinbelow. The control circuit 11 of FIG. 2 is substantially similar to that of FIG. 1 except for the following significant changes. First, note the absence from FIG. 2 of the plurality of Bypass switches BPl-BPn shown on FIG. 1. This deletion removes the motor-cam driven bypass action of the previous embodiment. Also, note the changed nomenclature of the previously designated Cam Hold switches CHl—CH*n* in FIG. 1, to the Motor Hold switch MH*l*-MH*n* of FIG. 2. Secondly, a plurality of Thermostat Bypass switches TB*n* are positioned in series with their respective Vend Motors M*l*-M*n.* The Thermostat Bypass switch TBl, shown as associated with the Vend Motor Ml, has its movable pole connected via a line 60 to the line 50, its normally closed fixed contact (Normal position) conncected to one end of Vend Motor Ml via line 62, and its normally open fixed contact (Trip position) connected via a line 64 to the line **40*b*. The remainder of the Thermostat Bypass switches TB2**-TB*n* are similarly positioned in their respective Actuating Circuits **12B-12*n*.** Also, a plurality of a magnetically actuated Brake and Pawl means MB*l*-MB*n,* each operatively coupled to their respective Vend Motors M*l*-M*n* are shown. When a Vend Motor is energized, the proximate magnetic field of the motor core actuates the corresponding Brake and Pawl means which then performs two functions. It first releases a mechanical brake on the motor shaft (not shown), and further actuates its corresponding Motor Hold switch. Illustratively, the Brake and Pawl means MBl is operably coupled to the movable pole of the Motor Hold switch MHl. Note that this Motor Hold switch MHl occupies the identical electrical position as the Cam Hold switch CHl of the embodiment described in FIG. 1, but, as will be described hereinbelow, it functions quite differently. A cam 58 is operably coupled to the Vend Motor Ml to actuate the Vend Motor switch VMl also as will be described hereinbelow.

A cycle of operation is initiated, as before, upon the receipt of the proper coins into the Coin Handling Means A-14. The Coin Handling Means A-14 then actuates the Coin Switch 20, thereby placing the control circuits 12A–12n into stable intermediate conditions ready for product selection and dispensing. The Coin Switch 20 energizes the Vend Relay 22 as described previously, and the Vend Relay 22 holds itself in the energized position via its own set of contacts SWl, also as previously described. The SW2 contacts of Vend Relay 22 thereafter complete the circuit path between the High side Ll of the input power, and all of the Motor Hold switches MHl-MHn in series, to the cascaded arrangement of Select Switches SSl-SSn in a manner identical to taht as previously described. The control circuits **12A–12*n*** are then in the stable intermediate condition and will so remain until a Select Switch has been actuated.

Upon operation of the Selection Switch, by means of one of the exemplary shown Pushbuttons in the Product Selection means 15, a dispense cycle is initiated. As before, a selection of the product associated with column 1 will be described to illustrate subsequent operation. Upon actuation of Pushbotton PBl the Select Switch SSl is momentarily moved to its Momentary position thereby applying power via the line 48 through the normally closed contacts of Sold Out switch SOlB and the Thermostat Bypass switch TBl to energize the Vend Motor Ml. The Brake and Pawl means MBl is simultaneously actuated, and said mechanism acturates the Motor Hold switch MHl such that its movable contact moves to the "Release" position. At the moment the Select Switch SSl is energized, Vend Motor Ml is energized, unbraked and capable of rotation. However, simultaneously, the Motor Hold switch MHl is moved to its Release position. Therefore the Vend Motor Ml begins rotation energized by the path: line 62, Thermostat Bypass switch TBl (Normal position), line 60, line 50, through the Motor Hold switch MHl (Release-position) and the remainder to the Motor Hold switch MH2-MHn in series (Brake position), through contacts SW2 (Operate-position), and Coin Switch 20 in its Normal- position, and further through the line 30 to the High side Ll of the input power.

At a predetermined point in the product dispensing cycle, as the Vend Motor continues to operate, Cam 58 actuates the Vend Motor switch VMl such tat the movable pole of VMl is now positioned into the Cam-position. The actuation of the Vend Motor switch VMl accomplishes the following two functions. The Vend Motor switch VMl, in moving to its Cam-position maintains the motor energized for the remainder of the product dispensing cycle. Also, this actuation of VMl breaks the holding path that was established to maintain the Vend Relay 22 energized, thereby causing the switches SW1 and SW2 to return to their Standby-positions. SW2 on transitioning to its Standby-position breaks the power circuit which had been energizing the Vend Motor M1 through the series string of Motor Hold switches MHl-MHn. (It should be noted that the Brake and Pawl means MB1 and Motor Hold switch MH1 play no noticable role in this very brief switching interval). For a normal dispensing cycle, one in which a jam of the dispensing mechanism does not occur, the Vend Motor M1 will continue rotation until the product has been dispensed. Cam 58 will, at the end of a dispense cycle, then actuate the Vend Motor switch VM1 such that its movable pole returns to the Notch-position thereby deenergizing the motor and restoring the actuating circuit 12A to the normal standby condition ready for subsequent actuations.

To illustrate the lockout features of the instant invention it will now be assumed that the vend cycle could not be completed due to a jam in the product dispensing mechanism. For illustrative purposes we will resume description of circuit operation at some point just beyond which the Vend Motor switch VM1 has been actuated to its Cam position. Thus Vend Motor M1 is energized via the path L1, Vend Motor switch VM1 (Cam position), line 60, thermostat Bypass switch TB1 (Normal position), and line 62. On occurrence of the jam condition the resulting internal temperature rise of the Vend Motor M1 will cause the Thermostat Bypass switch TB1 to transition to its Trip position and interrupt the power being supplied to the motor. As further Vend Motor rotation will now be precluded until the Thermostat Bypass switch TB1 is manually reset (as would be done say be a maintenance person), the Cam 58 will maintain the Vend Motor switch VM1 in the Cam position indefinitely. Consider now a subsequent customer attempting to make a purchase from the vending machine. On deposit of the proper coins, the Coin switch 20 would operate and energize the Vend Relay 22 as before, and the Vend Relay 22 would attempt to maintain itself in the energized position via the path as previously described, and its SW1 contacts. However, recall that the holding path for Vend Relay 22 requires that all of the Vend Motor switches VM1-VMn be in the Notch position. As Vend Motor switch VM1 has been jammed in the Cam position, the holding circuit would not be established were it not for the action of the Thermostat Bypass switch TB1. The bypass action of Thermostat Bypass switch TB1 is accomplished via the line 64, through the Thermostat Bypass switch TB1 (Tripped position), through the line 60, and thereafter through the Vend Motor switch VM1 in its Cam position, and up to the High side L1 of the input power. Thus it is clearly seen that the Thermostat Bypass switch TB1 in its Trip position provides a shunt path across the fixed contacts of the Vend Motor switch VM1. One additional feature of this embodiment of the instant invention also results from the actuation of the Thermostat Bypass switch, namely that subsequent selections of the product associated with the failed column cannot be made as it is impossible to actuate a Vend Motor via any path until its associated Thermostat Bypass switch has been manually reset. Thus an attempt by a subsequent customer to select the product associated with a failed column is ineffective.

Although the invention has been described in terms of selected preferred embodiments, the invention should not be deemed limited thereto, since other embodiments and modifications will readily occur to one skilled in the art. It is therefore to be understood that the appended claims are intended to cover all such modifications and changes as fall within the true spirit and scope of the invention.

What is claimed is:

1. A control circuit for a multiple-selection, independent column vending machine, said control circuit comprising:

a. coin operable credit establishing means having a first condition corresponding to the establishment of credit upon deposit of proper coinage, and a second condition corresponding to the cancellation of credit;

b. a plurality of customer operable product selection means, one selection means corresponding to each column, and each of said selection means having a momentary operable state;

c. a plurality of individual product dispensing means, each of said dispensing means operatively connected to one of said independent columns for dispensing a product;

d. a plurality of individual actuating circuits corresponding to each column, each of said actuating circuits operatively connected for actuating a corresponding product means;

e. each of said actuating circuits comprising:

i. drive motor means operable, in response to the momentary operable state of a corresponding product selection means for momentary energizing said drive motor means, by a first energizing path;

ii. cam means driven by said drive motor means;

iii. first cam actuated means having a first condition for maintaining said credit establishing means in said first condition for a first portion of a complete product dispensing cycle, and having a second condition for maintaining said credit establishing means in said second condition for a second portion of said dispensing cycle;

iv. second cam actuated means, having an initial condition and actuatable to a second condition by said momentary motor energization, for establishing a second motor energizing path to maintain energization of said motor means during said first portion of said dispensing cycle;

v. said first cam actuated means further providing a third motor energizing path for energizing said motor means during said second portion of said dispensing cycle; and vi. lockout switching means, operable directly by said cam means such that during a malfunction condition of said product dispensing means during said second portion of said dispensing cycle, said lockout switching means provides an alternate circuit path comprising a portion of said third motor energizing path for maintaining said credit establishing means in said first condition during a first portion of a subsequently ordered dispensing cycle.

2. The control circuit as recited in claim 1 wherein said first energizing path comprises: said momentary operable state of said selection means, said initial condition of said second cam actuated means and said first condition of said credit establishing means.

3. The control circuit as recited in claim 2 wherein said second energizing path comprises: a second condition of said second cam actuated means which second condition results from initial rotation of said drive motor means, and said first condition of said credit establishing means.

4. The control circuit as recited in claim 3 wherein said third energizing path comprises said condition of said first cam actuated means.

5. The control circuit as recited in claim 4 wherein, for at least one of said actuating circuits, said product selection means and said second cam actuated means each comprise single-pole-double-throw switching means, each means having a movable pole and two fixed contacts, wherein said product selection means movable pole is coupled to the fixed contact of said second cam actuated means which corresponds to said initial condition thereof, and the fixed contact of said product selection means corresponding to the momentary condition thereof is coupled to said drive motor means.

6. The control circuit as recited in claim 5 wherein said lockout switching means and said first cam actuated means each comprise single-pole-switching means, each means having a movable pole and at least a first fixed contact, said movable poles being electrically coupled, said electrically coupled poles independently mechanically operable in response to said cam means.

7. The control circuit as recited in claim 6 wherein:

a. said movable of said lockout switching means is coupled to its first fixed contact during a first condition thereof, and is not operatively coupled during a second condition thereof, b. said movable pole of said first cam actuated means is coupled to its second fixed contact during a second condition thereof for energizing said drive motor via said third energizing path, and is coupled to its first fixed contact during a first condition thereof for maintaining said credit establishing means in said first condition, c. a circuit interconnection means couples said first fixed contact of said lockout switching means to said first fixed contact of said first cam actuated means, d. said actuating circuit malfunction condition is characterized by the failure of said first cam actuated means to transition from said second condition thereof to said first condition thereof, and e. upon occurence of said malfunction condition, said lockout circuit means provides a shunt electrical path by coupling said electrically coupled movable poles to said circuit interconnection means via said movable pole of said lockout circuit means remaining coupled to said first fixed contact thereof.

8. The control circuit as recited in claim 5 wherein said lockout switching means and said first cam actuated means each comprise single-pole-double-throw switching means, each means having a movable pole and a first and second fixed contacts; said first cam actuated means movable pole mechanically operable in response to said cam means to provide a first condition wherein said movable pole is coupled to its first fixed contact and a second condition wherein said movable pole is coupled to its second fixed contact; said lockout switching means movable pole operable in response to an abnormal thermal condition of said drive motor means, corresponding to a jammed condition of said individual product dispensing means, to provide a normal condition wherein said movable pole is coupled to its first fixed contact and a trip condition wherein said movable pole is coupled to its second fixed contact.

9. The control circuit as in claim 8 wherein:

a. said lockout switching means movable pole is coupled to said first cam actuated means second fixed contact, and further has its second fixed contact coupled to said first cam actuated means first fixed contact b. said movable pole of said first cam actuated means is coupled to its second fixed contact during a second condition thereof for energizing said drive motor via said third energizing path, and is coupled to its first fixed contact during a first condition thereof for maintaining said credit establishing means in said first condition, c. said actuating circuit malfunciton condition is characterized by the failure of said first cam actuated means to transition from second condition thereof to said first condition thereof, d. upon occurrence of said malfunction condition said lockout circuit means provides a shunt electrical path by coupling said first and second fixed contacts of said first cam actuated means.

10. The control circuit as recited in claim 9 wherein said thermally operated lockout switching means trip condition is characterized as being unconditionally stable thereby requiring manual intervention to restore it to said normal condition, causing the associated jammed actuating circuit to remain in the bypassed condition until said manual intervention.

* * * * *

UNITED STATES PATENT OFFICE
CERTIFICATE OF CORRECTION

Patent No. 4,044,877 Dated August 30, 1977

Inventor(s) Paul F. Burton

It is certified that error appears in the above-identified patent and that said Letters Patent are hereby corrected as shown below:

Assignee line, delete "Ransom" and insert therefor --Ranson--.

Column 4, line 35, change "Vent" to --Vend--.

Column 5, line 19, change "to" to --no--.

Column 7, line 11, change "taht" to --that--;

line 26, change "acturates" tc --actuates--;

line 44, change "tat" to --that--.

Column 9, line 10, after "product" insert --dispensing--;

line 58, before "condition" insert --second--.

Column 10, line 11, after "movable" insert --pole--.

UNITED STATES PATENT OFFICE

CERTIFICATE OF CORRECTION

Patent No. 4,044,877 Dated August 30, 1977

Inventor(s) Paul F. Burton

It is certified that error appears in the above-identified patent and that said Letters Patent are hereby corrected as shown below:

Column 11, line 1, after "from" insert -- said --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*